US009227824B2

(12) United States Patent
Philipopoulos

(10) Patent No.: US 9,227,824 B2
(45) Date of Patent: Jan. 5, 2016

(54) ADJUSTABLE FORKLIFT LOAD BACKREST

(71) Applicant: Matthew John Philipopoulos, San Mateo, CA (US)

(72) Inventor: Matthew John Philipopoulos, San Mateo, CA (US)

( * ) Notice: Subject to any disclaimer, the term of this patent is extended or adjusted under 35 U.S.C. 154(b) by 41 days.

(21) Appl. No.: 14/261,129

(22) Filed: Apr. 24, 2014

(65) Prior Publication Data

US 2014/0318901 A1 Oct. 30, 2014

Related U.S. Application Data

(60) Provisional application No. 61/815,365, filed on Apr. 24, 2013.

(51) Int. Cl.
*B66F 9/075* (2006.01)
*B66F 9/12* (2006.01)

(52) U.S. Cl.
CPC ..... *B66F 9/12* (2013.01)

(58) Field of Classification Search
CPC ..... B66F 9/12; B66F 9/14; B66F 9/142; B66F 9/143; B66F 9/146
USPC ..... 187/222; 414/667
See application file for complete search history.

(56) References Cited

U.S. PATENT DOCUMENTS

| | | | | | |
|---|---|---|---|---|---|
| 2,748,966 | A * | 6/1956 | Gohrke | 414/667 | |
| 4,335,992 | A * | 6/1982 | Reeves | 414/667 | |
| 4,395,188 | A * | 7/1983 | Kaup | 414/622 | |
| 4,533,290 | A * | 8/1985 | Hackauf | 414/667 | |
| 4,708,576 | A * | 11/1987 | Conley | 414/607 | |
| 5,096,363 | A * | 3/1992 | Weinert et al. | 414/667 | |
| 5,139,385 | A * | 8/1992 | Chase et al. | 414/667 | |
| 5,456,565 | A * | 10/1995 | Pigott | B66F 9/12 | 187/222 |
| 7,909,563 | B2 * | 3/2011 | Prentice | 414/667 | |
| 8,708,383 | B1 * | 4/2014 | Roberts | B66F 9/18 | 294/67.33 |
| 2005/0196265 | A1 * | 9/2005 | Moore | B66F 9/08 | 414/785 |
| 2007/0079558 | A1 * | 4/2007 | Foroni | 49/375 | |
| 2009/0008951 | A1 * | 1/2009 | Whetstine | H01L 21/84 | 293/120 |
| 2009/0116945 | A1 * | 5/2009 | White et al. | 414/667 | |
| 2012/0076627 | A1 * | 3/2012 | Matti | 414/667 | |
| 2013/0177374 | A1 * | 7/2013 | Matti | 414/667 | |
| 2014/0166404 | A1 * | 6/2014 | Sharp | 187/222 | |
| 2014/0262625 | A1 * | 9/2014 | Sharp | 187/222 | |

* cited by examiner

*Primary Examiner* — William A Rivera
*Assistant Examiner* — Michael Riegelman

(57) ABSTRACT

An adjustable forklift load backrest has a first lateral support, a second lateral support and a central connector. The lateral supports are adjustably engaged with the central connector opposite each other. The width of the load backrest can be adjusted by moving the lateral supports closer together or farther away from each other. The lateral supports are affixed to the central connector by bolts traversing through bolt holes on the support arms and slotted openings on the connecting arms of the central connector.

11 Claims, 3 Drawing Sheets

ADJUSTABLE FORKLIFT LOAD BACKREST

The current application claims a priority to the U.S. Provisional Patent application Ser. No. 61/815,365 filed on Apr. 24, 2013.

FIELD OF THE INVENTION

The present invention relates generally to forklifts. More specifically, the present invention is an adjustable load backrest for forklifts that is universally mountable on all varying models of forklifts

BACKGROUND OF THE INVENTION

Forklifts are one of the most common types of equipment used for lifting and transporting heavy and/or bulky materials. The forklifts find particular use in manufacturing and warehousing operations involving large amounts of materials that cannot be efficiently lifted and transported by hand. Forklifts are available in many variations and are divided into multiple classes based on mechanism of operation. Because forklifts routinely lift and transport large, bulky, and heavy materials, it is of the utmost importance that the materials are stabilized during lifting and transportation. As a result, all forklifts are outfitted with a load backrest that is bolted to the forklift carriage. The carriage moves vertically along the forklift mast rails when lifting and lowering the forks. As any loads lifted by the forks are exposed to the mast rails, the load backrest prevents the loads from becoming unstable and falling backwards onto the mast rails. A common problem encountered when manufacturing or replacing the load backrest component of forklifts is the widely varying dimensions of the carriage component. This is due to the fact that there is no set of standards regarding the dimensions of forklifts. When replacing load backrests, manufacturers are required to create many variations of the load backrest component in order to accommodate the widely varying dimensions of individual forklift models. As a result, manufacturers face increased costs in purchasing and shipping the individualized load backrests. The process also results in logistical time delays. Finally, manufacturers are required to allocate warehouse space for storing the individualized load backrests. The present invention seeks to address the aforementioned issues and provide a practical and convenient solution.

The present invention is a load backrest that is adjustable with regards to size. The load backrest is universally mountable on all models of forklifts In its preferred embodiment, the present invention comprises a load backrest featuring a three piece design. The load backrest comprises a first support, a second support, and a central connector. The first support and second support are nested within the central connector and may slide along the central connector. By sliding the first support and second support along the central connector, a user may increase and decrease the size of the load backrest. The first support and second support are locked in place on the central connector by tightening bolts through elongated and slotted holes on the first support and second support. Alternatively, the three pieces of the load backrest may be permanently welded together following adjustment. The load backrest is mounted to the carriage by bolting the first support and second support to the left side and right side of the carriage. The first support and second support feature additional elongated and slotted openings that are designed to accommodate for varying bolt spacing arrangements across individual models of forklifts.

The object of the present invention is to provide a universally mountable load backrest that addresses a number of issues faced by forklift manufacturers. The present invention eliminates the need for manufacturers to purchase and store varying load backrests for individual models of forklifts. As such, manufacturers may universally utilize the present invention when replacing load backrests. This increases manufacturer efficiency while reducing incurred costs brought upon by the multiple types of load backrests.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced without the implementation of some features as they are described. It should be understood that some details have not been described in detail in order to not unnecessarily obscure focus of the invention.

Figure 1:
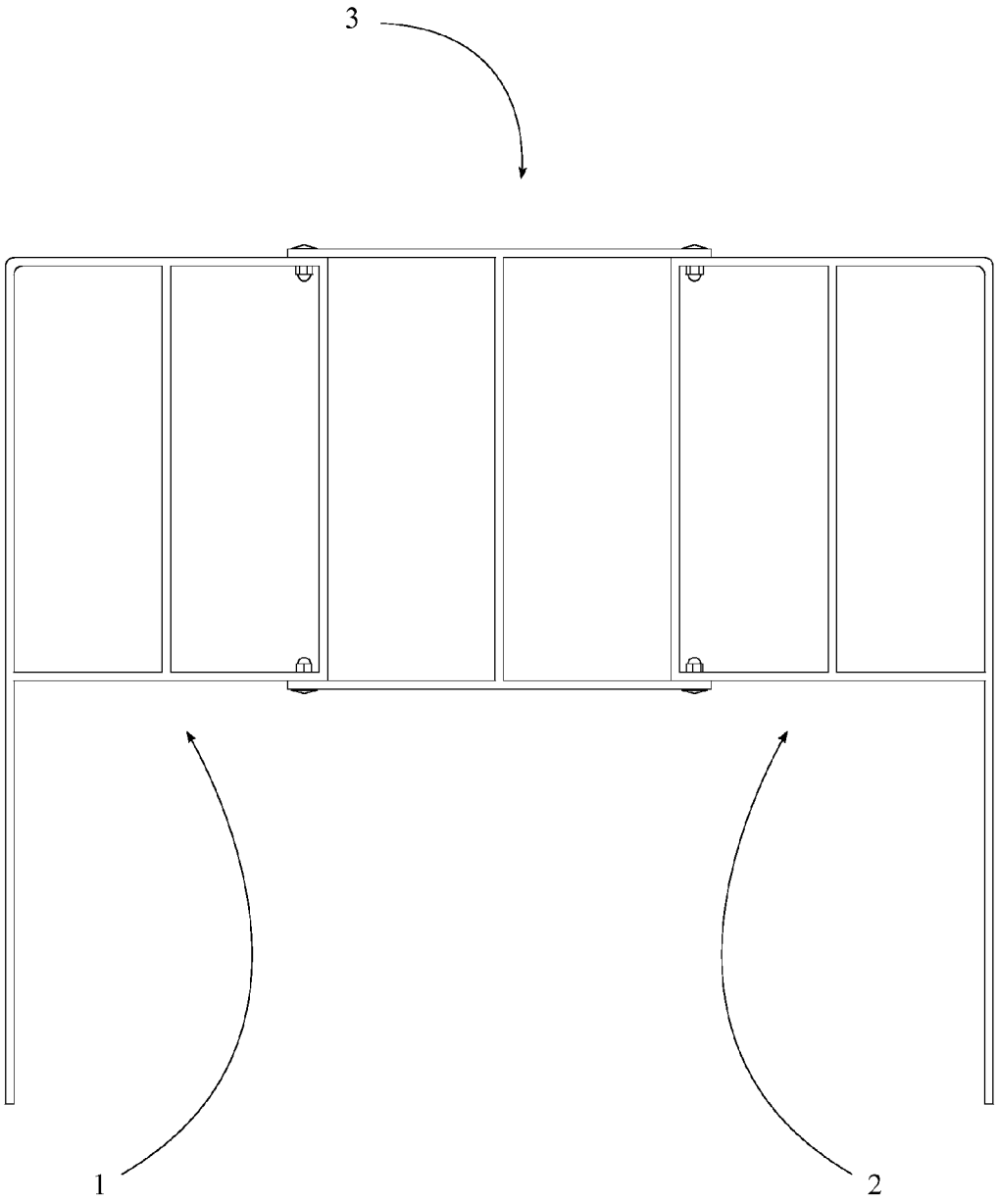
FIG. 1 is a front view of the present invention.
Figure 2:
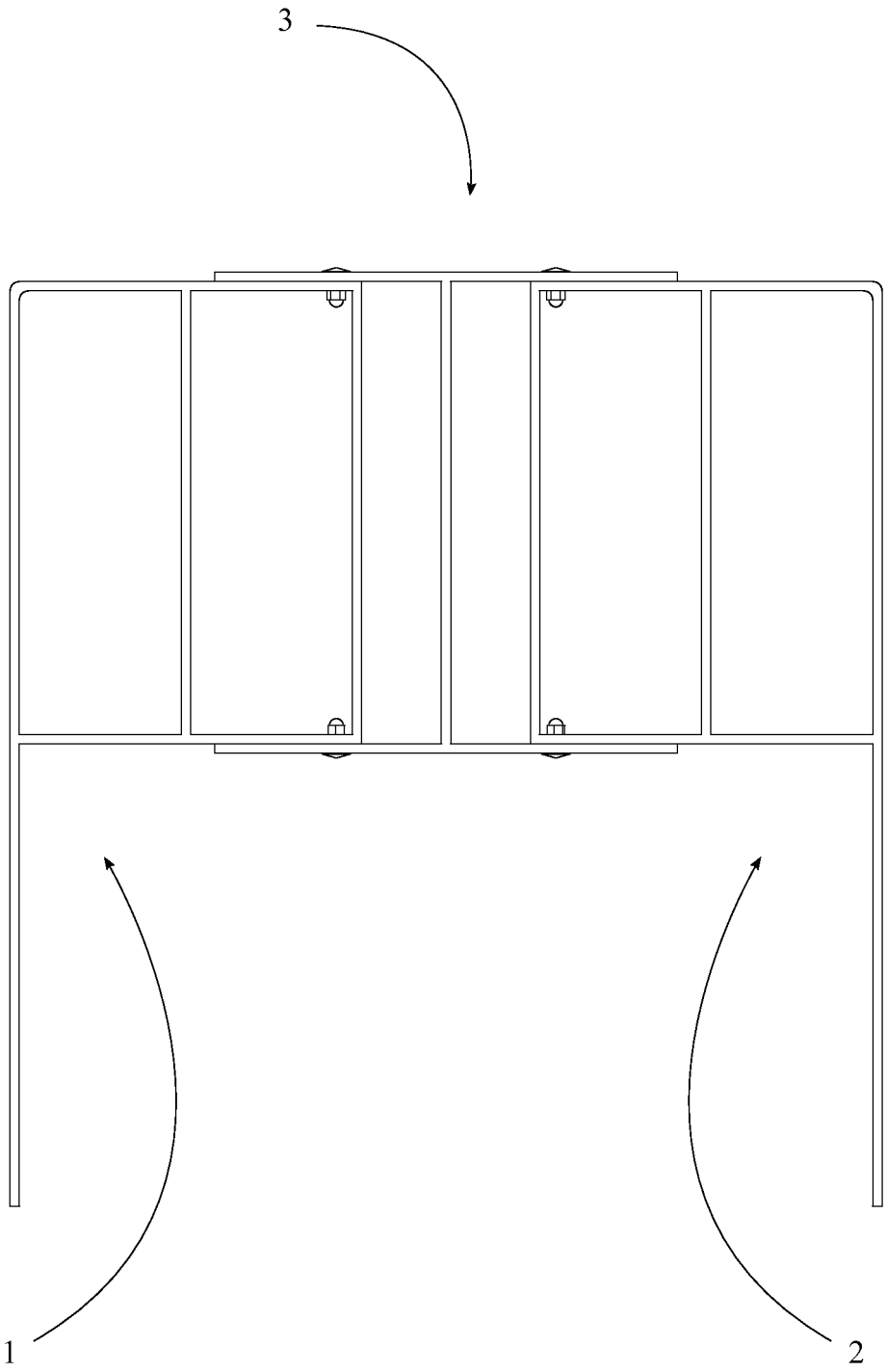
FIG. 2 is another front view of the present invention with adjusted width.

The present invention is an adjustable load backrest that is universally mountable to all forklifts The present invention is adjustable in order to accommodate the widely varying dimensions across individual models of forklifts. Referring to FIGS. 1-2, in its preferred embodiment, the present invention comprises a first lateral support 1, a second lateral support 2, and a central connector 3, having a generally planar form. The first lateral support 1 and the second lateral support 2 are positioned opposite each other about the central connector 3 and removably attached to the central connector 3, and the total width of the present invention is able to be adjusted by affixing the first lateral support 1 and the second lateral support 2 in a desired lateral location relative to the central connector 3. The first lateral support 1 and the second lateral support 2 are moved closer or further away from each other in order to adjust the width of the present invention. The first lateral support 1 and the second lateral support 2 are each mounted to opposing sides of a forklift as known in the art and industry.

The first lateral support 1 is attached to the central connector 3, and the second lateral support 2 is attached to the central connector 3 opposite the first lateral support 1. In order for the present invention to be adjustable, the first lateral support 1 and the second lateral support 2 are adjustably engaged with the central connector 3. More particularly, the first lateral support 1 is adjustably engaged to the central connector 3 by the connecting bracket 12 of the first lateral support 1 and the second lateral support 2 is adjustably engaged with the central connector 3 by the connecting bracket 12 of the second lateral support 2, wherein the first lateral support 1 and the second lateral support 2 can be adjusted closer to or further away from each other about the central connector 3.

In the preferred embodiment of the present invention, this means that the first lateral support 1 and the second lateral support 2 are removably attached to the central connector 3 in a desired position by bolts traversing through the lateral supports and the central connector 3. It is contemplated, however, that alternate means of adjustment may be comprised in alternate embodiments. For example, latches, hooks, collars or alternate fastening means may be used to secure the first lateral support 1 and the second lateral support 2 to the central connector 3, or the upper and lower connecting arms of the central connector 3 may comprise central openings within which the upper and lower support arms of the first lateral support 1 and the second lateral support 2 are inserted or nested. Additionally, it should be noted that in an alternate embodiment, the central connector 3 is not comprised and the first lateral support 1 and the second lateral support 2 are adjustably engaged to each other.

Figure 3:
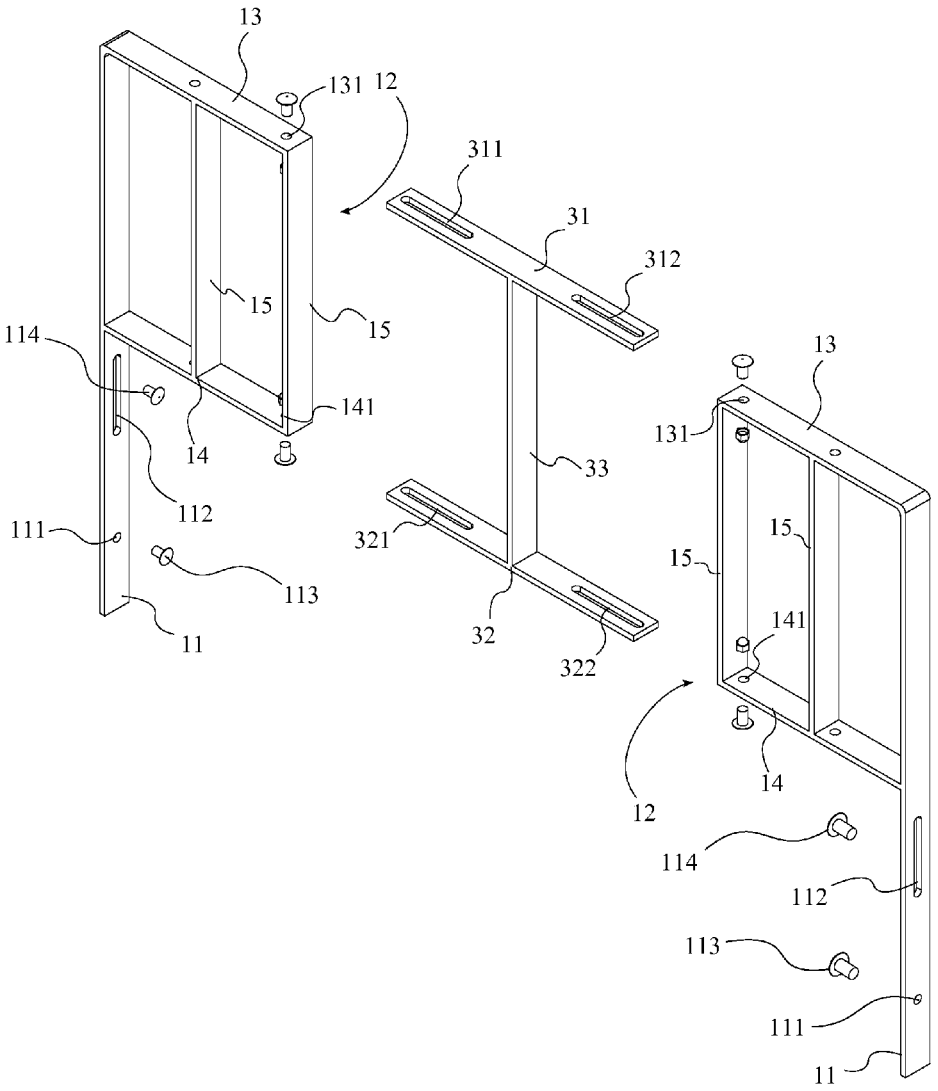
FIG. 3 is an exploded perspective view of the present invention.

Referring to FIG. 3, the first lateral support 1 and the second lateral support 2 are identical, and each comprises a vertical arm 11 and a connecting bracket 12. The connecting bracket 12 is positioned adjacent to the vertical arm 11 and is connected to the vertical arm 11, forming a flag shape with the connecting bracket 12 positioned at the top of the vertical arm 11.

In the preferred embodiment of the present invention the connecting bracket 12 comprises an upper support arm 13, a lower support arm 14 and at least one crossbar 15. The upper support arm 13 and the lower support arm 14 are oriented parallel to each other, and the upper support arm 13 and the lower support arm 14 are perpendicularly connected to the vertical arm 11.

Each of the at least one crossbar 15 is connected between the upper connecting arm 31 and the lower connecting arm 32. In the preferred embodiment of the present invention, each of the at least one crossbar 15 is oriented perpendicular to the upper connecting arm 31 and the lower connecting arm 32. The at least one crossbar 15 is present in order to block loads from sliding through the upper support arm 13 and the lower support arm 14 while the present invention is in use on a forklift However, fewer crossbars is better in order to not obstruct the forklift operator's vision.

The upper support arm 13 comprises a first bolt hole 131. The lower support arm 14 comprises a second bolt hole 141. The first bolt hole 131 and the second bolt hole 141 are positioned opposite the vertical arm 11 along the upper support arm 13 and the lower support arm 14, respectively. Additional bolt holes may be comprised as desired for additional support.

In the preferred embodiment of the present invention, the central connector 3 is I-shaped and comprises an upper connecting arm 31, a lower connecting arm 32 and a second lower slotted opening 322. The upper connecting arm 31 and the lower connecting arm 32 are oriented parallel to each other. The second lower slotted opening 322 is perpendicularly connected between the upper connecting arm 31 and the lower connecting arm 32.

In the preferred embodiment of the present invention, the upper connecting arm 31 comprises a first upper slotted opening 311 and a second upper slotted opening 312, which are traversed vertically through the upper connecting arm 31 and positioned symmetrically about the second lower slotted opening 322. Similarly, the lower connecting arm 32 comprises a first lower slotted opening 321 and a second lower slotted opening 322, which are traversed vertically through the lower connecting arm 32 and positioned symmetrically about the second lower slotted opening 322. In alternate embodiments, alternate arrangements of openings may be comprised, such as, but not limited to, more or fewer openings, or alternate shapes of openings such as circular or slotted.

The upper support arm 13 of the first lateral support 1 is removably secured to the upper connecting arm 31 of the central connector 3 by one of a plurality of bolts traversing through one of or both of the first upper slotted opening 311 and the second upper slotted opening 312 of the central connector 3 and the first bolt hole 131 of the upper support arm 13. In a similar fashion, the lower support arm 14 of the first lateral support 1 is removably secured to the lower connecting arm 32 of the central connector 3 by another of the plurality of bolts. The upper support arm 13 of the second lateral support 2 is removably secured to the upper connecting arm 31 of the central connector 3 opposite the upper support arm 13 of the first lateral support 1 by another of the plurality of bolts. The lower support arm 14 of the first lateral support 1 is removably secured to the upper connecting arm 31 of the central connector 3 opposite the lower support arm 14 of the first lateral support 1 by another of the plurality of bolts. At each of these attachment locations, the bolt is tightened against the surface around the opening in order to hold the components in place by friction.

The vertical arm 11 comprises a first carriage mounting opening 111 and a second carriage mounting opening 112. The vertical arm 11 is removably attached to a forklift by a first mounting bolt 113 traversing through the first carriage mounting opening 111 and a second mounting bolt 114 traversing through the second carriage mounting opening 112. In the preferred embodiment of the present invention, the first carriage mounting opening 111 and the second carriage mounting opening 112 are slotted and elongated openings in order to accommodate various different bolt hole spacing of different forklift models. In one embodiment of the present invention, the first carriage mounting opening 111 and the second carriage mounting opening 112 traverse laterally through the vertical arm 11. In another embodiment, the first carriage mounting opening 111 and the second carriage mounting opening 112 traverse longitudinally through the vertical arm 11. These said embodiments are for accommodating different mounting configurations where the carriage mounting locations on the forklift are oriented differently. In the embodiment where the first carriage mounting opening 111 and the second carriage mounting opening 112 are oriented longitudinally, an additional piece of material is needed to be added to the vertical arm in order to provide structural support for the openings.

The object of the present invention is to eliminate the need for forklift manufacturers to purchase and store multiple variants of load backrests for individual models of forklifts The present invention is adjustable and universally mountable to all forklift models. By providing a universal solution for replacing load backrests, the present invention increases manufacturer efficiency while reducing incurred costs for replacing the load backrests.

Although the invention has been explained in relation to its preferred embodiment, it is to be understood that many other possible modifications and variations can be made without departing from the spirit and scope of the invention as hereinafter claimed.

What is claimed is:

1. An adjustable forklift load backrest comprises:

a first lateral support;

a second lateral support;

a central connector;

the first lateral support and the second lateral support each comprise a vertical arm and a connecting bracket;

the connecting bracket comprises an upper support arm, a lower support arm and at least one crossbar;

the central connector comprises an upper connecting arm, a lower connecting arm and a central support arm;

the first lateral support being attached to the central connector;

the second lateral support being attached to the central connector opposite the first lateral support;

the connecting bracket being positioned adjacent to the vertical arm;

the connecting bracket being connected to the vertical arm;

the upper connecting arm comprises a first upper slotted opening and a second upper slotted opening;

the lower connecting arm comprises a first lower slotted opening and a second lower slotted opening;

the first upper slotted opening and the second upper slotted opening being traversed vertically through the upper connecting arm;

the first lower slotted opening and the second lower slotted opening being traversed vertically through the lower connecting arm;

the first upper slotted opening and the second upper slotted opening being positioned symmetrically about the central support arm; and the first lower slotted opening and the second lower slotted opening being positioned symmetrically about the central support arm.

2. The adjustable forklift load backrest as claimed in claim 1 comprises:

the first lateral support and the second lateral support being removably attached to the central connector.

3. The adjustable forklift load backrest as claimed in claim 1 comprises:

the first lateral support being adjustably engaged with the central connector by the connecting bracket of the first lateral support; and the second lateral support being adjustably engaged with the central connector by the connecting bracket of the second lateral support, wherein the first lateral support and the second lateral support can be adjusted closer to or further away from each other about the central connector.

4. The adjustable forklift load backrest as claimed in claim 3 comprises:

the upper support arm of the first lateral support being removably secured to the upper connecting arm of the central connector by one of a plurality of bolts;

the lower support arm of the first lateral support being removably secured to the lower connecting arm of the central connector by a second bolt;

the upper support arm of the second lateral support being removably secured to the upper connecting arm of the central connector by a third bolt; and the lower support arm of the second lateral support being removably secured to the lower connecting arm of the central connector by a fourth bolt.

5. The adjustable forklift load backrest as claimed in claim 1 comprises:

the vertical arm comprises a first carriage mounting opening and a second carriage mounting opening.

6. The adjustable forklift load backrest as claimed in claim 5 comprises:

the vertical arm adapted to be removably attached to a forklift by a first mounting bolt traversing through the first carriage mounting opening and a second mounting bolt traversing through the second carriage mounting opening.

7. The adjustable forklift load backrest as claimed in claim 1 comprises:

the upper support arm and the lower support arm being oriented parallel to each other; and the upper support arm and the lower support arm being perpendicularly connected to the vertical arm.

8. The adjustable forklift load backrest as claimed in claim 1 comprises:

each of the at least one crossbar being connected between the upper connecting arm and the lower connecting arm.

9. The adjustable forklift load backrest as claimed in claim 1 comprises:

each of the at least one crossbar being oriented perpendicular to the upper connecting arm and the lower connecting arm.

10. The adjustable forklift load backrest as claimed in claim 1 comprises:

the upper connecting arm and the lower connecting arm being oriented parallel to each other; and the central support arm being perpendicularly connected between the upper connecting arm and the lower connecting arm.

11. The adjustable forklift load backrest as claimed in claim 1 comprises:

the upper support arm comprises a first bolt hole;

the lower support arm comprises a second bolt hole; and the first bolt hole and the second bolt hole being positioned opposite the vertical arm along the upper support arm and the lower support arm, respectively.

* * * * *